US005489348A

United States Patent [19]

Knudsen et al.

[11] Patent Number: 5,489,348

[45] Date of Patent: Feb. 6, 1996

[54] METHOD FOR PREFLASHING FILAMENTS FOR X-RAY TUBE CATHODE ASSEMBLIES

[75] Inventors: Bruce A. Knudsen, Amsterdam, N.Y.; Clyde L. Briant, Barrington, R.I.

[73] Assignee: General Electric Company, Schenectady, N.Y.

[21] Appl. No.: 299,166

[22] Filed: Aug. 22, 1994

[51] Int. Cl.[6] ..... C21D 9/54

[52] U.S. Cl. ..... 148/595; 148/596

[58] Field of Search ..... 148/595, 596, 148/633, 634, 673

[56] References Cited

U.S. PATENT DOCUMENTS 556,974 5/1958 Smeaton ..... 148/673

3,149,006 9/1964 Abel et al. ..... 148/673

FOREIGN PATENT DOCUMENTS 475420 6/1975 U.S.S.R. ..... 148/673

*Primary Examiner*—Deborah Yee

*Attorney, Agent, or Firm*—R. Thomas Payne; James Magee, Jr.

[57] ABSTRACT

Methods of making an improved high performance x-ray system having an improved cathode assembly which reduces tube failure due to filament misalignment or sagging and prevents costly reflashing of the filament during the manufacturing process is disclosed.

13 Claims, 4 Drawing Sheets

METHOD FOR PREFLASHING FILAMENTS FOR X-RAY TUBE CATHODE ASSEMBLIES

RELATED APPLICATIONS

This application is related to commonly assigned U.S. patent application Ser. No. 08/299,165 (RD-23,859) of Knudsen et al., filed Aug. 22, 1994, and U.S. patent application Ser. No. 08/272,064 (RD-23,774) of Eggleston et al., filed Jul. 8, 1994, and incorporated by reference herein.

BACKGROUND OF THE INVENTION

The present invention relates to methods for making equipment for diagnostic and therapeutic radiology and, more particularly, to methods for making cathode assemblies used in x-ray generating equipment, such as computerized axial tomography (C.A.T.) scanners. Most particularly, the invention is directed to methods for making x-ray tube cathode structures by preflashing the filaments prior to assembly in the cathode cup, in order to eliminate coiled tungsten filament misalignment or sagging in the cathode cup.

Each x-ray tube is normally enclosed in an oil-filled protective casing. A glass envelope contains a cathode plate, a rotating disk target and a rotor that is part of a motor assembly that spins the target. A stator is provided outside the tube proximate to the rotor and overlapping therewith about two-thirds of the rotor length. The glass envelope is enclosed in an oil-filled lead casing having a window for the x-rays that are generated to escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to in excess of hundreds of thousands of volts) between the anode (positive) and the cathode (negative) and impinge on the anode, whereby they are abruptly slowed down. The anode, usually referred to as the target, is often of the rotating disc type, so that the electron beam is constantly striking a different point on the anode perimeter. The x-ray tube itself is made of glass, but is enclosed in a protective casing that is filled with oil to absorb the heat produced. High voltages for operating the tube are supplied by a transformer. The alternating current is rectified by means of rectifier tubes (or "valves") in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

X-ray tube performance can be affected by the alignment of the filament in the cathode assembly. Specifically, during x-ray tube manufacturing, it is important to be able to initially align the filament and have it stay aligned during completion of the manufacturing cycle and during operation of the x-ray tube.

Previously, coiled tungsten filaments used in x-ray tubes were assembled and then aligned in the cathode cup. Once assembled, the filaments were heated to about 2800° C. to produce the desired microstructure. During this heating, when assembled in the cathode cup, many filaments sagged and thus move out of alignment making it necessary to reseat them in the cathode cup and repeat the flashing or the heating to 2800° C. In some instances, this step had to be repeated up to as many as five (5) times until the filament positioned in the cathode cup had both the desired alignment and microstructure.

Because repeating the heating step to produce an aligned filament with the desired microstructure causes increased manufacturing costs, the need to develop new methods for providing a properly aligned coiled tungsten filament in the x-ray tube cathode cup with the desired microstructure became apparent. It has been determined that methods for preflashing and then assembling the filament in the cathode cup having proper alignment with the desired microstructure are desirable. Such methods should provide for a one step assembly process for the coiled tungsten filaments in the x-ray tube cathode cup during the manufacturing process such that the filaments are properly aligned and have the desired microstructure.

SUMMARY OF THE INVENTION

In carrying out the present invention in preferred forms thereof, we provide improved methods for manufacturing an x-ray cathode assembly for use in x-ray tubes, such as those incorporated in diagnostic and therapeutic radiology machines, for example, computer tomography scanners. Illustrated embodiments of the resulting x-ray cathode assembly and the cup having the filament made utilizing the method of the present invention disclosed herein, are in the form of an x-ray system having an x-ray tube.

In accordance with one aspect of the present invention there is provided a method for preflashing the filament used in a cathode assembly for an x-ray system having an x-ray tube therein.

Another aspect of the present invention includes a method for assembling a filament in the cathode cap of an x-ray tube, comprising the steps of: placing at least one filament in an enclosure having an inert atmosphere; heating the at least one filament in the enclosure to a sufficient temperature for a sufficient time to produce a desired microstructure; and removing the at least one filament from the enclosure.

A further aspect of the present invention includes the step of inserting the at least one filament into a cathode assembly.

A still further aspect of the present invention includes the steps of heating the filament in the cathode cup at a temperature for a sufficient time to properly align the filament in the cathode.

Another aspect of the present invention includes the step of assembling the cathode assembly including the cup having the filament into the x-ray tube.

Accordingly, an object of the present invention is to provide an improved method for making an x-ray system including an x-ray tube having a properly assembled and aligned filament in the cathode assembly cup.

A further object of the present invention is to provide a method for making an x-ray tube which includes an improved method of making the cathode assembly.

A still further object of the present invention is to provide an improved method for assembling the coiled tungsten filament into the cup of the cathode assembly.

Another object of the present invention is to provide a method for assembling a coiled tungsten filament in the cathode cup so as to avoid repositioning and realignment of the filament in the cup after the filament is heated to produce a desired microstructure.

A further object of the present invention is to provide a method for assembling the filament into the cathode cup so that proper alignment is achieved in a single step.

Other objects and advantages of the invention will be apparent from the following description, the accompanying drawings and the appended claims.

DESCRIPTION OF THE PREFERRED EMBODIMENT

Figure 1A:
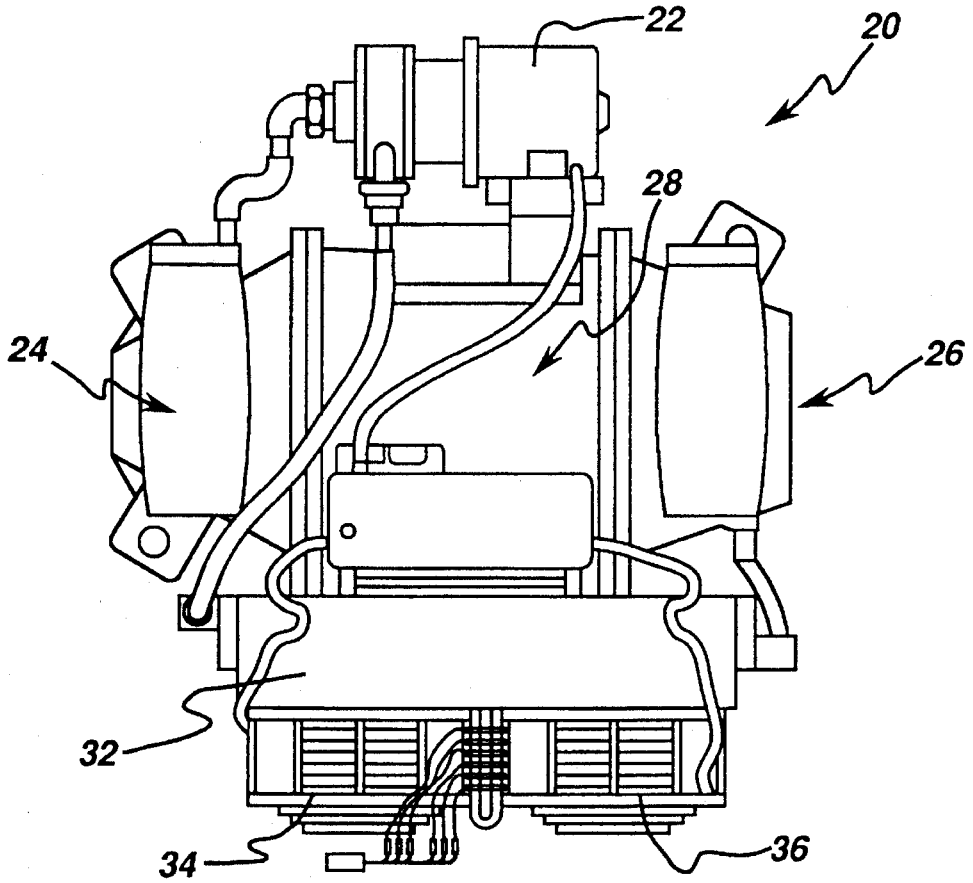
FIG. 1*a* is a plan view of a representative x-ray system.
Figure 1B:
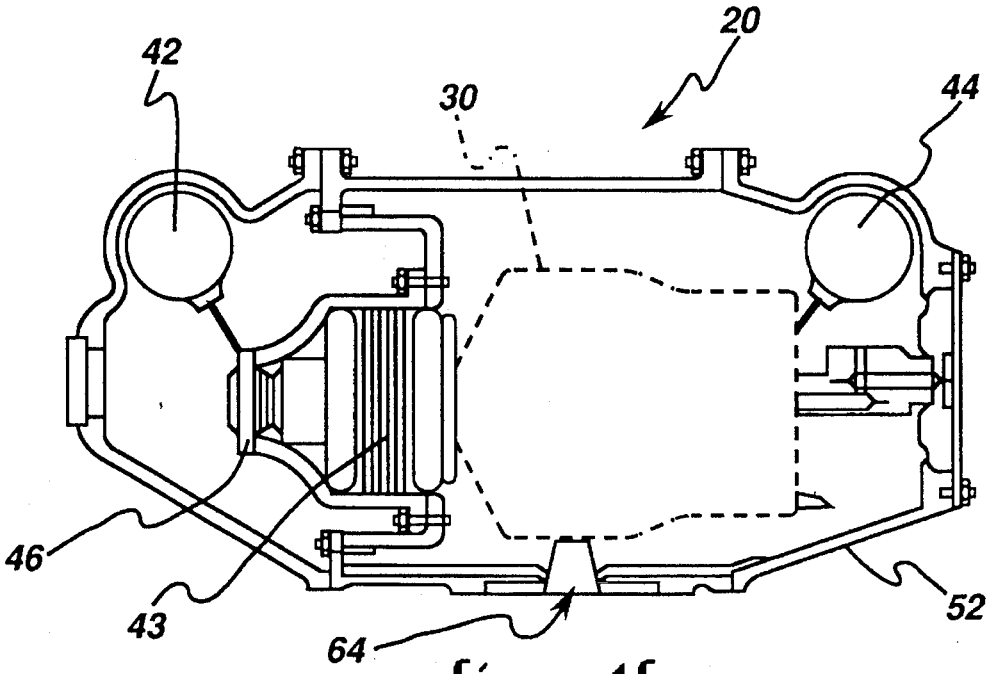
FIG. 1*b* is a sectional view with parts removed of the x-ray system of FIG. 1*a;*

A representative x-ray system in which an x-ray tube made, in accordance with the present invention, by one preferred method thereof, is illustrated as generally designated by the numeral 20 in FIGS. 1*a,* 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b,* electrical connections are provided in the anode receptacle 42 and the cathode receptacle 44.

Figure 2:
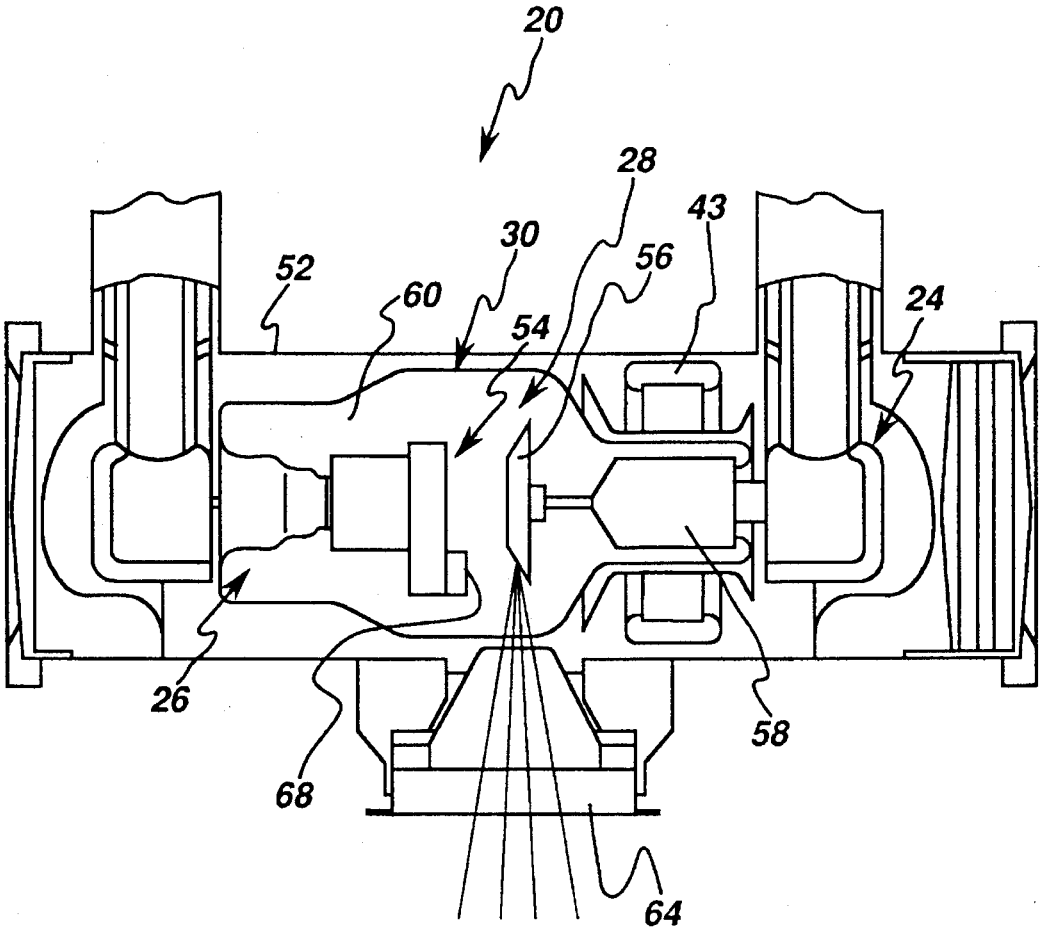
FIG. 2 is a schematic representation of another representative x-ray system having an x-ray tube positioned therein.

As shown in FIG. 2, the x-ray system 20 comprises a casing 52 preferably made of aluminum and lined with lead and a cathode plate 54, a rotating target disc 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target disc 56 for allowing generated x-rays to exit the x-ray system 20.

Figure 3:
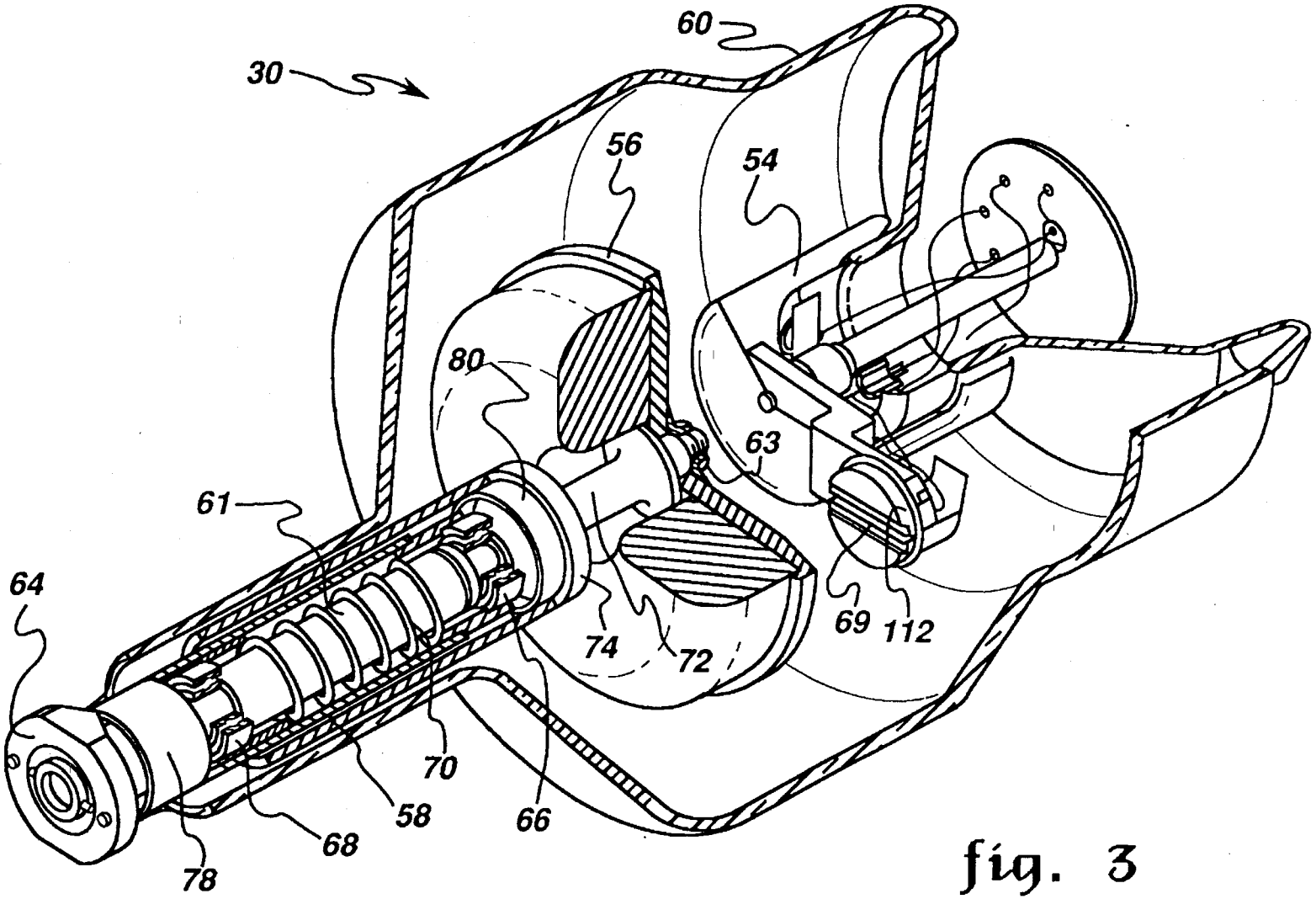
FIG. 3 is a partial perspective view of a representative x-ray tube with parts removed, parts in section, and parts broken away.

As shown in FIG. 3, the cathode 54 is positioned inside the glass envelope 60. As is well known, inside the glass envelope there is a vacuum of about $10^{-5}$ to about $10^{-9}$ torr. The electricity generates x-rays that are aimed from the cathode filament 68 to the anode target or the top of the target disc 56. The target disc is conventionally connected to a rotating shaft 61. A front bearing 66 and a rear bearing 68 are operatively positioned on the shaft 61 and are held in position in a conventional manner.

A preload spring 70 is positioned about the shaft 61 between the bearings 66, 68 for maintaining load on the bearings during expansion and contraction of the anode assembly. A rotor stud 72 is utilized to space the end of the rotor most proximate the target 56 from the rotor hub 74. The bearings, both front 66 and rear 68, are held in place by bearing retainers 78 and 80. The rotor assembly also includes a stem ring and a stem all of which help to provide for the rotation of the rotor 58 with the target 56.

The temperature in the area of the filament 69 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature appears to decrease.

Figure 4:
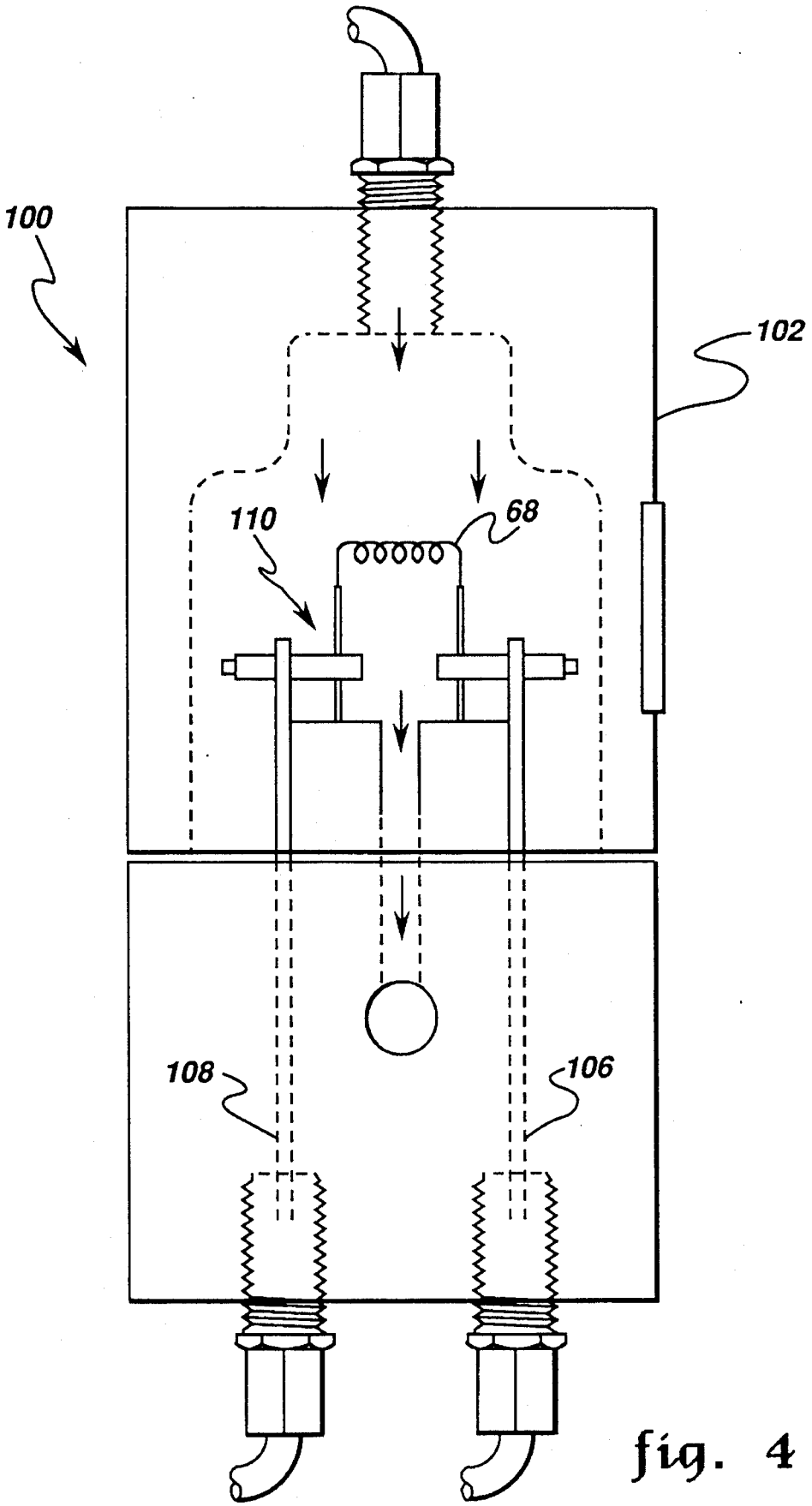
FIG. 4 is a sectional view of one embodiment of an apparatus for preflashing filament prior to assembling in the cathode cup according to one method of the present invention.

Referring now to FIG. 4, therein is shown a representative apparatus for preflashing filaments in accordance with the method of the present invention, generally designated by the reference numeral 100. The filament preflash apparatus 100 comprises an enclosure member 102, a base member 104 preferably made of a solid phenolic, for housing conductive rods 106, 108. The enclosure 102 is preferably made of a phenolic material and more preferably made of glass reinforced epoxy, but could be made of quartz, Pyrex® or other similar material. The base member 104 is operatively connected to the enclosure 102, by conventional means such as by force of gravity. The phenolic material should be readily machinable or drilled out, if solid, and needs to be able to prevent gas such as oxygen from penetrating it. If the material is tubular, it should also have a seal flange connected thereto.

A filament holding structure or filament holding means 110, for adjustably positioning preferably one filament and possibly a plurality of filaments, depending upon available power, inside the enclosure 102 is operatively connected to the conductive rods 106, 108, which are in turn connected to a conventional power source (not shown).

The filament holding means 110, which provides for the legs of the filament to be loosely held thereby allowing stresses due to heating, to relieve themselves and coil growth to take place in an unconstrained manner, is preferably constructed of steel, stainless steel or other conductive metal which is easily machinable, heat resistant and oxidation resistant. The rods 106, 108 are preferably made of Kovar but could be made from stainless steel or other rigid conductive material.

During the prior art manufacturing process, the filament 68 was positioned in the stator cup 112 and then heated (flashed) to about 2800° C. It was during the heating "flash" step to 2800° C. that caused the coiled tungsten filaments to move out of alignment in the stator cup and to sag. Such a misaligned or sagged filament would result in an x-ray tube that produced out of focus x-rays and/or x-rays of an area that was outside the area expected or aimed. Also, such misalignment by as little as two (2) mils, caused overheating of the filament which resulted in tube failure, i.e., not producing a good quality x-ray. Another result of filament misalignment was filament shorting, which also resulted in poor quality x-rays.

Since the heating or "flash" step was accomplished with the filament positioned in the cathode cup, when the filament sagged or was misaligned, it was necessary for an operator or an assembler to realign the filament thereby adding additional costs in the form of increased manufacturing time and increased labor to properly locate the filament in the cathode cup.

Specifically, during the prior manufacturing process, when the filament was found to be out of alignment specification, an operator would reposition it with tweezers or other small precision tools by bending and twisting the filament as necessary. During this operation, it was not unusual for filaments to break off because the adjustments to place the filament within specifications was greater than the filament's recrystalized condition would allow due to the filament being brittle after being heated to about 2800° C.

Once the operator or assembler successfully repositioned the filament, it was again necessary to "flash" the filament to 2800° C. in order to provide the desired microstructure which includes being fully recrystalized and having large grain interlocking to provide creep resistance at high temperatures. Once the filament was properly aligned with the desired microstructure, the cathode could then be assembled into the x-ray tube assembly.

If the filament were installed in the cathode cup and then heated before it was recrystalized, the filament would expand (get longer) and bow, sag or bend because the filament legs were held so tight in the cathode cup during the expansion caused by the application of heat thereto. In this condition, failure would be very likely.

Since reflashing to correct misaligned filaments was an extra manufacturing step in terms of the process for manufacturing the x-ray tube, it was determined that a separate or preflash step might eliminate or at least reduce the number of times the filament had to be repositioned in the cathode cup and reheated to 2800° C. in order to produce the desired microstructure.

Utilizing the filament preflash apparatus 100, in one manufacturing method of the present invention at least one filament and up to as many filament(s) as available power will allow are first preferably positioned in the enclosure member 102 on the filament holding means 110. The enclosure member can have, for example, an inert atmosphere comprising, for example, about 90 percent nitrogen and about 10 percent hydrogen and may be performed in an atmosphere of 100 percent hydrogen, but preferably with about a three percent (3%) to about a ten percent (10%) hydrogen content with the remainder being nitrogen. The apparatus also includes gas purging structure 114 for purging the apparatus's atmosphere after at least one filament has been preflashed.

During the preflashing process, power is provided to the rods 106, 108 for about 10 seconds as the temperature is increased up to about 2800° C. Once at 2800° C., power is maintained for about two (2) to about five (5) seconds, preferably two (2) seconds, and then cut off. Once the filament has been preflashed to about 2800° C. and the atmosphere inside the enclosure has been purged, the filament or filaments, as the case may be are removed therefrom. The removed filament(s) should now have the desired microstructure and, after verifying same, are positioned in the cathode cup 112. Once the filaments are properly positioned and aligned in the cathode cup, the cathode cup filament combination is heated to a temperature of about 2200° C.

With this preflash process, applicants have found that the necessity for reseating and then reheating (reflashing) filaments in the cathode cup has been greatly reduced, if not totally eliminated.

While the methods disclosed herein constitute preferred embodiments of the invention, it is to be understood that the invention is not limited to these precise methods, and that changes may be made therein without departing from the scope of the invention which is defined in the appended claims.

What is claimed is:

1. A method for preflashing at least one filament suitable for use in an x-ray tube, the method comprising the steps of:

providing a filament preflash structure having an inert atmosphere including a filament holding structure;

inserting at least one filament suitable for use in an x-ray tube into the preflash structure operatively positioned on the filament holding structure;

heating the at least one filament to a temperature sufficient to provide a desired microstructure, wherein during the heating step, sufficient electric power is provided to heat the filament up to about 2800° C. and then hold the filament temperature at 2800° C. for about two (2) to about five (5) seconds; and removing the at least one filament from the filament preflash structure.

2. The method of claim 1, further comprising the step of:

inserting the at least one filament into a cathode cup.

3. The method of claim 2, further comprising the step of:

heating the cathode cup-filament combination to a temperature of about 2200° C.

4. The method of claim 1, wherein the inert atmosphere comprises:

from about three percent (3%) to about ten percent (10%) hydrogen and about ninety-seven (97%) to about ninety percent (90%) nitrogen.

5. The method of claim 1, wherein the inert atmosphere comprises:

about one-hundred percent (100%) hydrogen.

6. The method of claim 1, wherein the inert atmosphere comprises:

about three percent (3%) hydrogen and about ninety-seven percent (97%) nitrogen.

7. The method of claim 1, wherein the filament removed from the filament structure has been fully recrystalized with large grain interlocking to provide creep resistance at high temperatures.

8. A method for preflashing at least one filament suitable for use in an x-ray tube, the method comprising the steps of:

providing a filament preflash structure having an inert atmosphere including a filament holding structure;

inserting at least one filament suitable for use in an x-ray tube into the preflash structure operatively positioned on the filament holding structure;

heating the at least one filament to a temperature sufficient to provide a desired microstructure, wherein during the heating step, sufficient power is provided to heat the filament to a temperature of about 2800° C. and then to hold the filament at 2800° C. for about two (2) seconds; and removing the at least one filament from the filament preflash structure.

9. The method of claim 8, further comprising the step of:

inserting the at least one filament into a cathode cup.

10. The method of claim 9, further comprising the step of:

heating the cathode cup-filament combination to a temperature of about 2200° C.

11. The method of claim 8, wherein the inert atmosphere comprises:

from about three percent (3%) to about ten percent (10%) hydrogen and about ninety-seven (97%) to about ninety percent (90%) nitrogen.

12. The method of claim 8, wherein the inert atmosphere comprises:

about one-hundred percent (100%) hydrogen.

13. The method of claim 8, wherein the inert atmosphere comprises:

about three percent (3%) hydrogen and about ninety-seven percent (97%) nitrogen.

* * * * *